US010411338B2

(12) United States Patent
Yoo et al.

(10) Patent No.: US 10,411,338 B2
(45) Date of Patent: Sep. 10, 2019

(54) ANTENNA STRUCTURE AND ELECTRONIC DEVICE INCLUDING THE SAME

(71) Applicant: SAMSUNG ELECTRONICS CO., LTD., Suwon-si, Gyeonggi-do (KR)

(72) Inventors: Chae Up Yoo, Seoul (KR); Ho Jung Nam, Goyang-si (KR); Min Cheol Seo, Seoul (KR); Sung Koo Park, Suwon-si (KR); Jung Ho Park, Hwaseong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 76 days.

(21) Appl. No.: 15/435,715

(22) Filed: Feb. 17, 2017

(65) Prior Publication Data

US 2017/0244163 A1 Aug. 24, 2017

(30) Foreign Application Priority Data

Feb. 19, 2016 (KR) ..... 10-2016-0020035

(51) Int. Cl.

| | |
|---|---|
| ***H01Q 1/38*** | (2006.01) |
| ***H01Q 1/52*** | (2006.01) |
| ***H01Q 9/04*** | (2006.01) |
| ***H01Q 21/06*** | (2006.01) |

(52) U.S. Cl.

CPC ..... *H01Q 1/521* (2013.01); *H01Q 1/38* (2013.01); *H01Q 9/0442* (2013.01); *H01Q 21/06* (2013.01)

(58) Field of Classification Search

CPC ..... H01Q 1/521; H01Q 1/38; H01Q 9/0442; H01Q 21/06

See application file for complete search history.

(56) References Cited

U.S. PATENT DOCUMENTS

| | | | | |
|---|---|---|---|---|
| 9,237,211 | B2 | 1/2016 | Tabe | |
| 2004/0219956 | A1* | 11/2004 | Iwai | H01Q 1/24 455/575.3 |
| 2012/0013519 | A1* | 1/2012 | Hakansson | H01Q 1/243 343/835 |
| 2012/0034954 | A1 | 2/2012 | Tabe | |
| 2014/0242903 | A1* | 8/2014 | DeLuis | H01Q 1/521 455/39 |
| 2014/0266149 | A1 | 9/2014 | Martinez et al. | |

FOREIGN PATENT DOCUMENTS

| | | |
|---|---|---|
| KR | 10-1580546 | 12/2015 |

* cited by examiner

*Primary Examiner* — Graham P Smith
(74) *Attorney, Agent, or Firm* — Nixon & Vanderhye P.C.

(57) ABSTRACT

An electronic device includes a carrier having a surface, a first antenna radiator configured to transmit and/or receive a signal of a specific frequency band, a second antenna radiator configured to transmit and/or receive a signal of the specific frequency band, a communication circuit electrically connected to the first antenna radiator and the second antenna radiator, and a processor configured to control the communication circuit. The first antenna radiator includes a first conductive pattern disposed at a portion of the surface of the carrier. The second antenna radiator includes a second conductive pattern disposed at another portion of the surface of the carrier. The first antenna radiator includes a first open stub extending from one point of the first conductive pattern and configured to provide a transmission coefficient between the first antenna radiator and the second antenna radiator that is lower than a specific value at the specific frequency band.

9 Claims, 12 Drawing Sheets

ANTENNA STRUCTURE AND ELECTRONIC DEVICE INCLUDING THE SAME

CROSS-REFERENCE TO RELATED APPLICATION

This application is based on and claims priority under 35 U.S.C. § 119 to a Korean patent application filed on Feb. 19, 2016 in the Korean Intellectual Property Office and assigned Serial number 10-2016-0020035, the disclosure of which is incorporated by reference herein in its entirety.

TECHNICAL FIELD

The present disclosure relates generally to an antenna mounted on an electronic device.

BACKGROUND

Portable electronic devices such as smartphones or tablet PCs may access wireless communication networks as they include antennas for transmitting and receiving wireless signals.

The antennas may transmit and receive signals of frequency bands ranging from a band of several hundred MHz to a band of several GHz to connect to a wireless communication network such as a cellular network. The antennas, for example, may be disposed inside and/or outside the electronic device.

Because the antennas mounted on the electronic device are mounted in the limited interior spaces of the electronic devices, the antennas may be arranged very close to each other. For example, when adjacent antennas transmit and receive signals of neighboring (or the same) frequencies, signals may interfere with each other. This may lower the overall performance of the antennas, for example, may deteriorate isolation characteristics. Moreover, when the housing of the electronic device is formed of a conductive material (e.g., a metal), the radiation performance of the antenna may be further lowered.

SUMMARY

Various example aspects of the present disclosure address at least the above-mentioned problems and/or disadvantages and to provide at least the advantages described below. Accordingly, an example aspect of the present disclosure is to provide an antenna that includes an open stub in a conductive pattern formed on a carrier to lower a transmission coefficient between antennas (e.g., to improve isolation), and an electronic device including the same.

In accordance with an example aspect of the present disclosure, an electronic device may include a carrier, a first antenna radiator configured to transmit and/or receive a signal of a specific frequency band, a second antenna radiator configured to transmit and/or receive a signal of the specific frequency band, a communication circuit electrically connected to the first antenna radiator and the second antenna radiator, and a processor configured to control the communication circuit. The first antenna radiator may include a first conductive pattern formed at a portion of a surface of the carrier. The second antenna radiator may include a second conductive pattern formed at another portion of the surface of the carrier. The first antenna radiator may include a first open stub extending from one point of the first conductive pattern such that a transmission coefficient between the first antenna radiator and the second antenna radiator is lower than a specific value at the specific frequency band.

In accordance with another example aspect of the present disclosure, an antenna mounted on an electronic device may include a carrier, a first antenna radiator configured to transmit and/or receive a signal of a specific frequency band, and a second antenna radiator configured to transmit and/or receive a signal of the specific frequency band. The first antenna radiator includes a first conductive pattern formed at a portion of a surface of the carrier. The second antenna radiator includes a second conductive pattern formed at another portion of the surface of the carrier. The first antenna radiator includes a first open stub extending from one point of the first conductive pattern such that a transmission coefficient between the first antenna radiator and the second antenna radiator is lower than a specific value at a specific frequency band.

Other aspects, advantages, and salient features of the disclosure will become apparent to those skilled in the art from the following detailed description, which, taken in conjunction with the annexed drawings, discloses various example embodiments of the present disclosure.

BRIEF DESCRIPTION OF THE DRAWINGS

The above and other aspects, features, and attendant advantages of the present disclosure will be more apparent and readily appreciated from the following detailed description, taken in conjunction with the accompanying drawings, in which like reference numerals refer to like elements, and wherein.

Throughout the drawings, it should be noted that like reference numbers are used to depict the same or similar elements, features, and structures.

DETAILED DESCRIPTION

Figure 1:
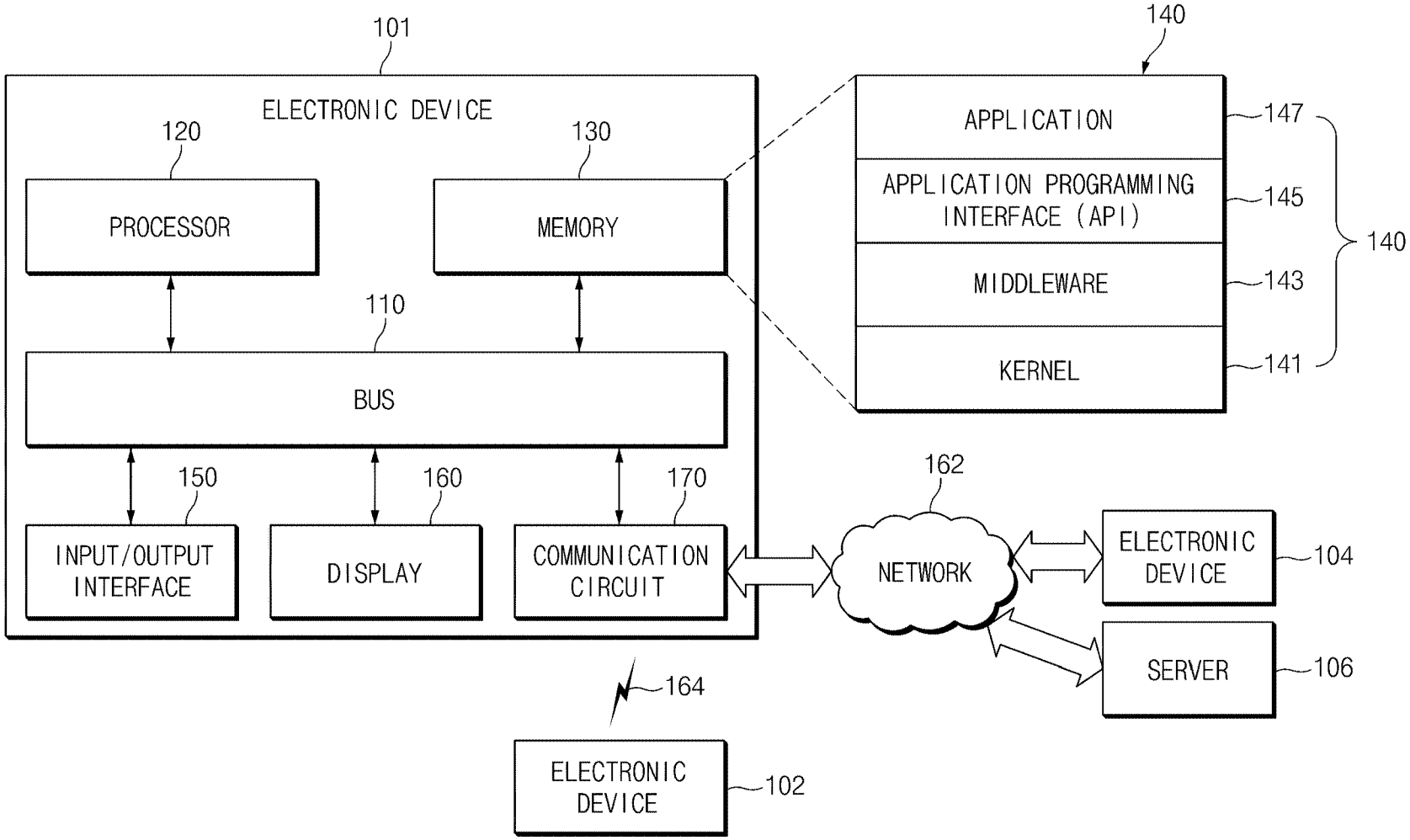
FIG. 1 is a diagram illustrating an example electronic device in a network environment according to various example embodiments of the present disclosure.

Hereinafter, various example embodiments of the present disclosure will be described with reference to the accompanying drawings. Accordingly, those of ordinary skill in the art will recognize that modifications, equivalents, and/or alternatives of the various embodiments described herein can be variously made without departing from the scope and spirit of the present disclosure. With regard to description of drawings, similar components may be marked by similar reference numerals.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it can be directly coupled with/to or connected to the other element or an intervening element (e.g., a third element) may be present. On the other hand, when an element (e.g., a first element) is referred to as being "directly coupled with/to" or "directly connected to" another element (e.g., a second element), it should be understood that there are no intervening element (e.g., a third element).

According to the situation, the expression "configured to" used herein may be used interchangeably with, for example, the expression "suitable for", "having the capacity to", "designed to", "adapted to", "made to", or "capable of". The term "configured to" may not denote only "specifically designed to" in hardware. Instead, the expression "a device configured to" may mean that the device is "capable of" operating together with another device or other components. CPU, for example, a "processor configured to perform A, B, and C" may refer, for example, to a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in this disclosure are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the disclosure, they may not be interpreted to exclude embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), MP3 players, mobile medical devices, cameras, and wearable devices, or the like, but is not limited thereto. According to various embodiments of the present disclosure, the wearable devices may include accessories (e.g., watches, rings, bracelets, ankle bracelets, glasses, contact lenses, or head-mounted devices (HMDs)), cloth-integrated types (e.g., electronic clothes), body-attached types (e.g., skin pads or tattoos), or implantable types (e.g., implantable circuits) or the like, but is not limited thereto.

In some embodiments of the present disclosure, the electronic device may be one of home appliances. The home appliances may include, for example, at least one of a digital video disk (DVD) player, an audio, a refrigerator, an air conditioner, a cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ or PlayStation™), an electronic dictionary, an electronic key, a camcorder, or an electronic panel, or the like, but is not limited thereto.

In another embodiment of the present disclosure, the electronic device may include at least one of various medical devices (e.g., various portable medical measurement devices (a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (e.g., a navigation device for vessels and a gyro compass), avionics, a security device, a vehicular head unit, an industrial or home robot, an automatic teller's machine (ATM) of a financial company, a point of sales (POS) of a store, or an internet of things (e.g., a bulb, various sensors, an electricity or gas meter, a spring cooler device, a fire alarm device, a thermostat, an electric pole, a toaster, a sporting apparatus, a hot water tank, a heater, and a boiler), or the like, but is not limited thereto.

According to some embodiments of the present disclosure, the electronic device may include at least one of furniture or a part of a building/structure, an electronic board, an electronic signature receiving device, a projector, or various measurement devices (e.g., a water service, electricity, gas, or electric wave measuring device), or the like, but is not limited thereto. In various embodiments of the present disclosure, the electronic device may be one or a combination of the aforementioned devices. The electronic device according to some embodiments of the present disclosure may be a flexible electronic device. Further, the electronic device according to an embodiment of this disclosure is not limited to the aforementioned devices, but may include new electronic devices produced due to the development of technologies.

Hereinafter, electronic devices according to an embodiment of this disclosure will be described with reference to the accompanying drawings. The term "user" used herein may refer to a person who uses an electronic device or may refer to a device (e.g., an artificially intelligent electronic device) that uses an electronic device.

FIG. 1 is a diagram illustrating an example electronic device in a network environment according to various example embodiments of the present disclosure.

Referring to FIG. 1, the electronic device 101, 102, 104 or the server 106 according to various embodiments may be connected to each other through a network 162 or a short-range communication 164. Referring to FIG. 1, the electronic device 101 may include a bus 110, a processor (e.g., including processing circuitry) 120, a memory 130, an input/output interface (e.g., including input/output interface circuitry) 150, a display 160, and a communication circuit 170. In some embodiments, the electronic device 101 may exclude at least one of the elements or may additionally include another element.

The bus 110 may include, for example, a circuit that connects the components 110 to 170 and transfers communications (e.g., control messages and/or data) between the components.

The processor 120 may include various processing circuitry, such as, for example, and without limitation, one or more of a dedicated processor, a central processing unit (CPU), an application processor (AP), or a communication processor (CP). The processor 120, for example, may execute operations or data processing related to the control and/or communication of at least one other component of the electronic device 101.

The memory 130 may include volatile and/or nonvolatile memories. The memory 130, for example, may store a command or data related to at least one other component of the electronic device 101. According to an embodiment, the memory 130 may store software and/or a program 140. The program 140, for example, may include a kernel 141, middleware 143, an application programming interface (API) 145, and/or an application program (or an application) 147. At least some of the kernel 141, the middleware 143, or the API 145 may be referred to as an operating system (OS).

The kernel 141, for example, may control or manage system resources (e.g., the bus 110, the processor 120, and the memory 130) that are used to execute operations or functions implemented in the other programs (e.g., the middleware 143, the API 145, or the applications 147). The kernel 141 may provide an interface through which the middleware 143, the API 145, or the applications 147 access individual components of the electronic device 101 to control or manage the system resources.

The middleware 143, for example, may function as an intermediary that allows the API 145 or the applications 147 to communicate with the kernel 141 to exchange data.

The middleware 143 may process one or more work requests received from the application programs 147, according to their priorities. For example, the middleware 143 may give a priority, by which a system resource (e.g., the bus 110, the processor 120, or the memory 130) of the electronic device 101 may be used, to at least one of the application programs 147. For example, the middleware 143 may perform scheduling or load balancing for the one or more work requests by processing the one or more work requests according to the priority given to the at least one of the application programs 1047.

The API 145 is an interface used, by the application 147, to control a function provided by the kernel 141 or the middleware 143, and may include, for example, at least one interface or function (e.g., an instruction), for example, for file control, window control, image processing, and text control.

The input/output interface 150 may include various input/output interface circuitry and, for example, may function as an interface that may transfer a command or data that are input from the user or another external device to another element (other elements) of the electronic device 101. The input/output interface 150 may output a command or data received from another component (other elements) of the electronic device to the user or anther external device 101.

The display 160, for example, may include a liquid crystal display (LCD), a light emitting diode (LED) display, an organic light emitting diode (OLED) display, a microelectromechanical system (MEMS) display, or an electronic paper display, or the like, but is not limited thereto. The display 160, for example, may display various contents (e.g., a text, an image, a video, an icon, and a symbol). The display 160 may include a touch screen and receive, for example, a touch, a gesture, a proximity, or a hovering input using an electronic pen or the user's body.

The communication circuit 170, for example, may set a communication between the electronic device 101 and an external device (e.g., a first external electronic device 102, a second external electronic device 104, or a server 106). For example, the communication circuit 170 may be connected to a network 162 through a wireless communication or a wired communication to communicate with the external device (e.g. the second external electronic device 104 or the server 106).

The wireless communication is, for example, a cellular communication protocol, and, for example, may use at least one of long-term evolution (LTE), LTE-advanced (ATE-A), code division multiple access (CDMA), wideband CDMA (WCDMA), a universal mobile telecommunications system (UMTS), wireless broadband (WiBro), or a global system for mobile communications (GSM). Furthermore, the wireless communication, for example, may include a short range communication 164. The short range communication 164, for example, may include at least one of wireless fidelity (Wi-Fi), Bluetooth, near field communication (NFC), magnetic stripe transmission (MST), or GNSS.

An MST may generate a pulse according to transmission data by using an electromagnetic signal, and the pulse may generate a magnetic field signal. The electronic device 101 may transmit the magnetic field signal to a point of sales (POS), detect the magnetic field signal by using an MST reader, and restore the data by converting the detected magnetic signal into an electrical signal.

The GNSS may include at least one of, for example, a global positioning system (GPS), a global navigation satellite system (Glonass), a Beidou navigation satellite system (hereinafter, "Beidou"), or the European global satellite-based navigation system (or Galileo), according to an in-use area or a bandwidth. Hereinafter, in the present disclosure, the "GPS" may be interchangeably used with the "GNSS". The wired communication may include at least one of, for example, a universal serial bus (USB), a high definition multimedia interface (HDMI), recommended standard-232 (RS-232), and a plain old telephone Service (POTS). The network 162 may include at least one of communication networks, for example, a computer network (e.g., a LAN or a WAN), the Internet, or a telephone network.

The first and second external electronic devices 102 and 104 may be the same or different type devices from the electronic device 101. According to an embodiment, the server 106 may include a group of one or more servers. According to various embodiments of the present disclosure, all or some of the operations executed by the electronic device 101 may be executed by another or a plurality of electronic devices (e.g. the electronic devices 102 and 104 or the servers 106). According to an embodiment of this disclosure, when the electronic device 101 should execute some functions or services automatically or upon request, it may request at least some functions associated with the functions or services from another device (e.g. the electronic devices 102 and 104 or the server 106), in place of or in addition to directly executing the functions or services. The other electronic device (e.g., the electronic device 102 or 104 or the server 106) may execute a requested function or an additional function, and may transfer the result to the electronic device 101. The electronic device 101 may process the received result directly or additionally, and may provide a requested function or service. To this end, for example, the cloud computing, distributed computing, or client-server computing technologies may be used.

Figure 2:
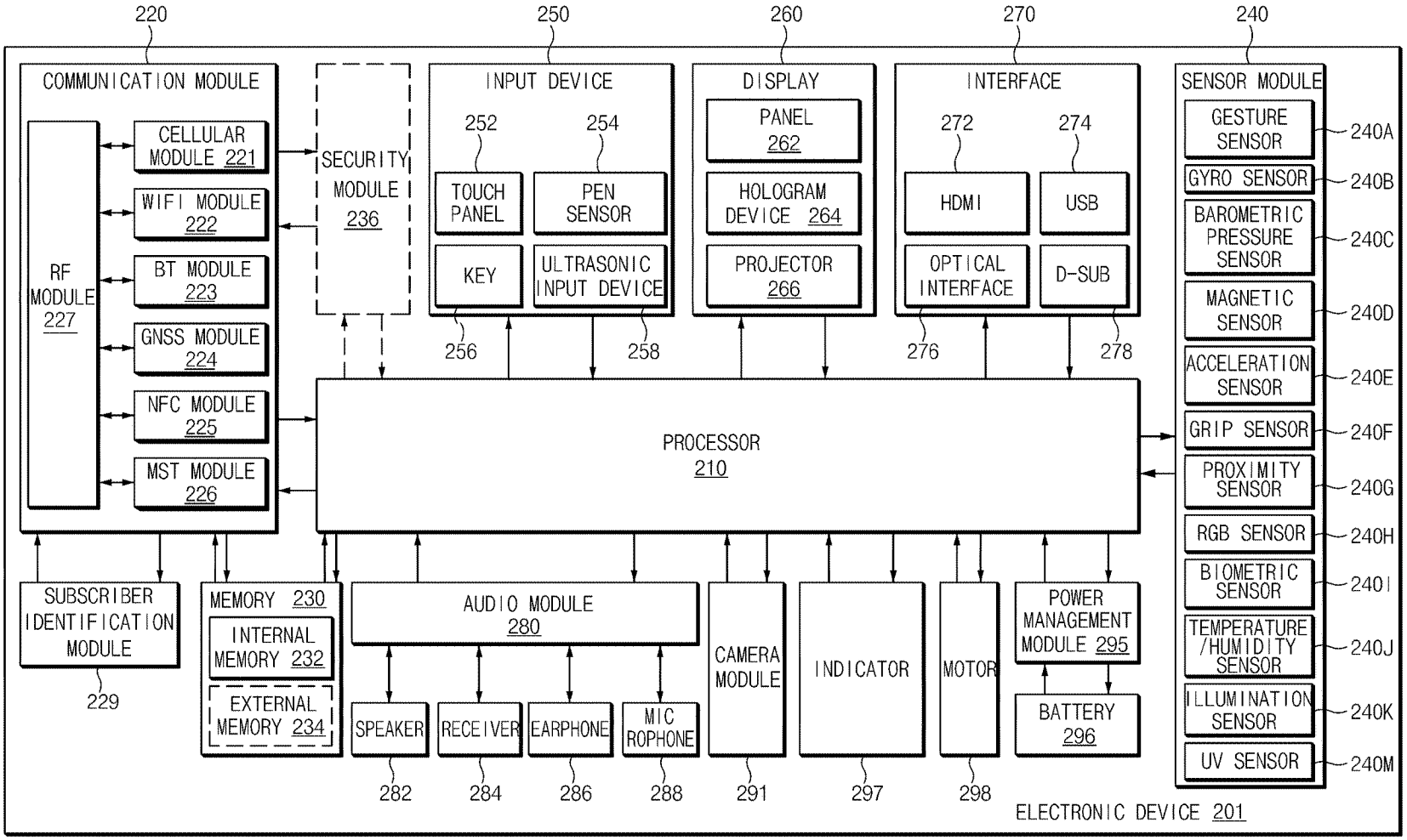
FIG. 2 is a block diagram illustrating an example electronic device according to various example embodiments of the present disclosure.

FIG. 2 is a block diagram illustrating an example electronic device according to various example embodiments of the present disclosure.

Referring to FIG. 2, an electronic device 201 may include, for example, the whole part or a part of the electronic device 101 illustrated in FIG. 1. The electronic device 201 may include at least one processor (e.g., an application processor (AP) (e.g., including processing circuitry) 210, a communication module (e.g., including communication circuitry) 220, a subscriber identification module (SIM) card 224, a memory 230, a security module 236, a sensor module 240, an input device (e.g., including input circuitry) 250, a display 260, an interface (e.g., including interface circuitry) 270, an audio module 280, a camera module 291, a power management module 295, a battery 296, an indicator 297, or a motor 298.

The processor 210 may include various processing circuitry and control a plurality of hardware or software components connected to the processor 210 by driving an operating system or an application program and perform a variety of data processing and calculations. The processor 210 may be implemented by, for example, a System on Chip (SoC). According to an embodiment, the processor 210 may further include a graphical processing unit (GPU) and/or an image signal processor. The processor 210 may include at least some (e.g., a cellular module 221) of the components illustrated in FIG. 2. The processor 210 may load instructions or data, received from at least one other component (e.g., a non-volatile memory), in a volatile memory to process the loaded instructions or data, and may store various types of data in a non-volatile memory.

The communication module 220 may have the same or similar structure to the communication circuit 170 of FIG. 1. The communication module 220 may include various communication circuitry, such as, for example, and without limitation, a cellular module 221, a Wi-Fi module 222, a Bluetooth module 223, a GNSS module 224 (e.g., a GPS module, a Glonass module, a Beidou module, or a Galileo module), an NFC module 225, an MT module 226, and a radio frequency (RF) module 227.

The cellular module 221 may provide a voice call, a video call, a text message service, or an Internet service through, for example, a communication network. According to an embodiment, the cellular module 221 may distinguish between and authenticate electronic devices 201 within a communication network using a subscriber identification module (e.g., the SIM card 229). According to an embodiment, the cellular module 221 may perform at least some of the functions that the processor 210 may provide. According to an embodiment of this disclosure, the cellular module 221 may include a communication processor (CP).

Each of the Wi-Fi module 222, the Bluetooth module 223, the GNSS module 224, the NFC module 225, or the MST module 226, for example, may include a processor for processing data transmitted/received through the corresponding module. According to some embodiments, at least some (e.g., two or more) of the cellular module 221, the Wi-Fi module 222, the Bluetooth module 223, the GNSS module 224, the NFC module 225, and the MST module 226 may be included in one Integrated Chip (IC) or IC package.

The RF module 227 may transmit/receive, for example, a communication signal (e.g., an RF signal). The RF module 227 may include, for example, a transceiver, a Power Amp Module (PAM), a frequency filter, a Low Noise Amplifier (LNA), or an antenna. According to another embodiment, at least one of the cellular module 221, the Wi-Fi module 222, the Bluetooth module 223, the GNSS module 224, the NFC module 225, or the MST module 226 may transmit and receive an RF signal through a separate RF module.

The subscriber identification module 229 may include, for example, a card including a subscriber identification module and/or an embedded SIM, and may further include unique identification information (e.g., an integrated circuit card identifier (ICCID)) or subscriber information (e.g., international mobile subscriber identity (IMSI)).

The memory 230 (e.g., the memory 130) may include, for example, an internal memory 232 and/or an external memory 234. The internal memory 232 may include at least one of, for example, a volatile memory (e.g., a dynamic random access memory (DRAM), a static RAM (SRAM), a synchronous dynamic RAM (SDRAM), and the like) and a non-volatile memory (e.g., a one-time programmable read only Memory (OTPROM), a programmable ROM (PROM), an erasable and programmable ROM (EPROM), an electrically erasable and programmable ROM (EEPROM), a flash memory (e.g., a NAND flash memory or a NOR flash memory), a hard driver, or a solid state drive (SSD).

The external memory 234 may further include a flash drive, for example, a Compact Flash (CF), a Secure Digital (SD), a Micro Secure Digital (Micro-SD), a Mini Secure Digital (Mini-SD), an eXtreme Digital (xD), a memory stick, or the like. The external memory 234 may be functionally and/or physically connected to the electronic device 201 through various interfaces.

The security module 236 is a module including a storage space having a relatively high security level as compared with the memory 230, and may be a circuit that guarantees safe data storage and a protected execution environment. The security module 236 may be implemented by a separate circuit, and may include a separate processor. The security module 236, for example, may be present in a detachable smart chip or a secure digital (SD) card, or may include an embedded secure element (eSE) embedded in a fixed chip of the electronic device 201. Further, the security module 236 may be driven by an operation system (OS) that is different form t the operating system of the electronic device 201. For example, the security module 236 may be operated based on a java card open platform (JCOP) operating system.

The sensor module 240, for example, may measure a physical quantity or detect an operational state of the electronic device 201, and may convert the measured or detected information to an electrical signal. The sensor module 240 may include, for example, at least one of a gesture sensor 240A, a gyro sensor 240B, an atmospheric (e.g., barometric) pressure sensor 240C, a magnetic sensor 240D, an acceleration sensor 240E, a grip sensor 240F, a proximity sensor 240G, a color sensor 240H (for example, a RGB sensor), a biometric sensor 240I, a temperature/humidity sensor 240J, an illumination sensor 240K, and an ultraviolet (UV) sensor 240M. Additionally or alternatively, the sensor module 240 may include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 240 may further include a control circuit for controlling one or more sensors included therein. In some embodiments, the electronic device 201 may further include a processor configured to control the sensor module 240 as a part of or separately from the processor 210, and may control the sensor module 240 while the processor 210 is in a sleep state.

The input device 250 may include various input circuitry, such as, for example, and without limitation, a touch panel 252, a (digital) pen sensor 254, a key 256, or an ultrasonic input device 258. The touch panel 252 may use at least one of, for example, a capacitive type, a resistive type, an infrared type, and an ultrasonic type. The touch panel 252 may further include a control circuit. The touch panel 252 may further include a tactile layer, and provide a tactile reaction to a user.

The (digital) pen sensor 254 may include, for example, a recognition sheet which is a part of the touch panel or a separate recognition sheet. The key 256 may include, for example, a physical button, an optical key, or a keypad. The ultrasonic input device 258 may detect ultrasonic waves generated by an input tool through a microphone (e.g., a microphone 288) and may identify data corresponding to the detected ultrasonic waves.

The display 262 (e.g., the display 260) may include a panel 264, a hologram device 266, or a projector 1666. The panel 262 may include a component equal or similar to the display 160 of FIG. 1. The panel 262 may be implemented to be, for example, flexible, transparent, or wearable. The panel 262 may be formed as a single module together with the touch panel 252. The hologram device 264 may show a three dimensional image in the air using an interference of light. The projector 266 may display an image by projecting light onto a screen. The screen may be located, for example, in the interior of or on the exterior of the electronic device 201. According to an embodiment, the panel 262 may include a pressure sensor (for a force sensor) that may measure the strength of a pressure for a touch of the user. The pressure sensor may be implemented integrally with the touch panel 252 or may be implemented by one or more sensors that are separate from the touch panel 252. According to an embodiment of this disclosure, the display 260 may further include a control circuit for controlling the panel 262, the hologram device 264, or the projector 266.

The interface 270 may include various interface circuitry, such as, for example, and without limitation, a high-definition multimedia interface (HDMI) 272, a universal serial bus (USB) 274, an optical interface 276, or a D-subminiature (D-sub) 278. The interface 270 may be included in, for example, the communication circuit 170 illustrated in FIG. 1. Additionally or alternatively, the interface 270 may include, for example, a mobile high-definition link (MHL) interface, a secure digital (SD) card/multimedia card (MMC) interface, or an infrared data association (IrDA) standard interface.

The audio module 280 may bilaterally convert, for example, a sound and an electrical signal. At least some elements of the audio module 280 may be included in, for example, the input/output interface 150 illustrated in FIG. 1. The audio module 280 may process sound information input or output through, for example, a speaker 282, a receiver 284, earphones 286, the microphone 288, or the like.

The camera module 291 is a device which may photograph a still image and a dynamic image. According to an embodiment, the camera module 291 may include one or more image sensors (e.g., a front sensor or a back sensor), a lens, an Image Signal Processor (ISP) or a flash (e.g., an LED or xenon lamp).

The power management module 295 may manage, for example, power of the electronic device 201. According to an embodiment of this disclosure, the power management module 295 may include a Power Management Integrated Circuit (PMIC), a charger Integrated Circuit (IC), or a battery or fuel gauge. The PMIC may have a wired and/or wireless charging scheme. Examples of the wireless charging method may include, for example, a magnetic resonance method, a magnetic induction method, an electromagnetic wave method, and the like. Additional circuits (for example, a coil loop, a resonance circuit, a rectifier, etc.) for wireless charging may be further included. The battery gauge may measure, for example, a residual quantity of the battery 296, and a voltage, a current, or a temperature while charging. The battery 296 may include, for example, a rechargeable battery and/or a solar battery.

The indicator 297 may indicate particular status of the electronic device 201 or a part thereof (e.g., the processor 210), for example, a booting status, a message status, a charging status, or the like. The motor 298 may convert an electrical signal into mechanical vibrations, and may generate a vibration or haptic effect. Although not illustrated, the electronic device 201 may include a processing device (e.g., a GPU) for supporting mobile TV. The processing unit for supporting mobile TV may process, for example, media data pursuant to a certain standard of Digital Multimedia Broadcasting (DMB), Digital Video Broadcasting (DVB), or media flow (MediaFlow™).

Each of the elements described in the disclosure may include one or more components, and the terms of the elements may be changed according to the type of the electronic device. In various embodiments of the present disclosure, the electronic device may include at least one of the elements described in the disclosure, and some elements may be omitted or additional elements may be further included. Some of the elements of the electronic device according to various embodiments of the present disclosure may be coupled to form one entity, and may perform the same functions of the corresponding elements before they are coupled.

Figure 3A:
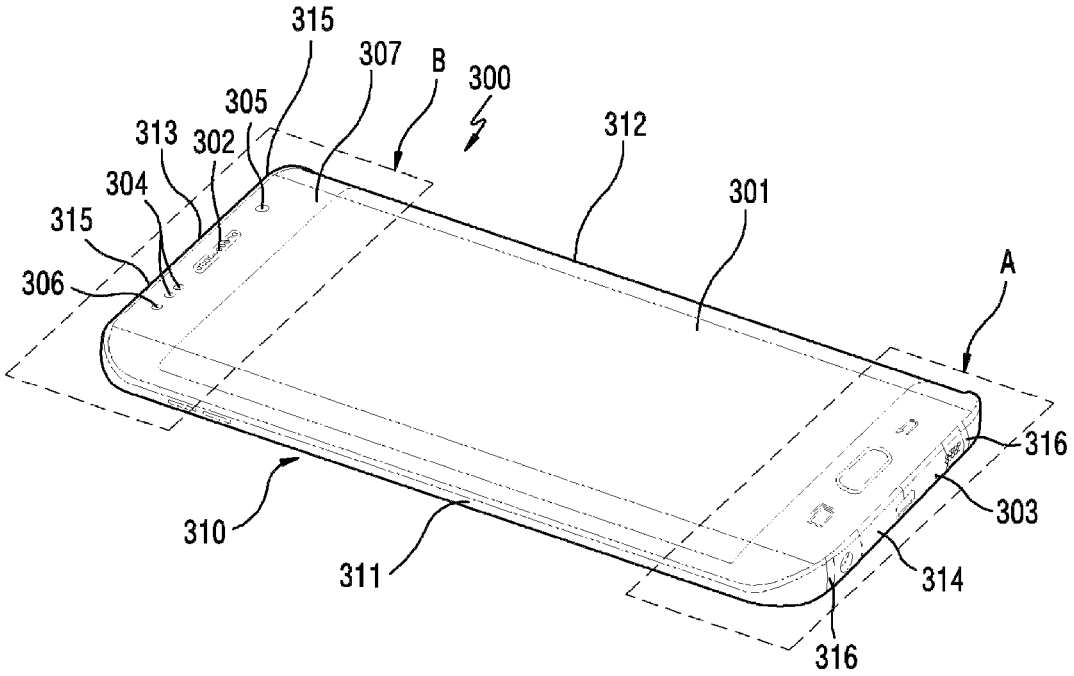
FIG. 3A is a diagram illustrating a front perspective view of an electronic device according to various example embodiments of the present disclosure.

FIG. 3A is a diagram illustrating a front perspective view of an electronic device according to various example embodiments of the present disclosure.

Referring to FIG. 3A, the electronic device 300, for example, may correspond to the electronic device 101 of FIG. 1 and the electronic device 201 of FIG. 2. A display 301 may be installed on a front surface 307 of the electronic device 300. A speaker unit 302 for receiving a voice of a counterpart may be installed above the display 301. A microphone 303 for transmitting a voice of the user of the electronic device to a counterpart may be installed below the display 301.

According to an embodiment, components for supporting various functions of the electronic device 300 may be arranged around the speaker unit 302. The components may include one or more sensor modules 304. The sensor module 304, for example, may include at least one of a luminance sensor (e.g., an optical sensor), a proximity sensor, an infrared ray sensor, and an ultrasonic wave sensor. According to an embodiment, the components may include a front camera 305. According to an embodiment, the components may include an LED indicator 306 for notifying the user of statuses of the electronic device 300.

According to various embodiments, the electronic device 300 may include a conductive member 310. According to an embodiment, the conductive member 310 is disposed in a peripheral area of the electronic device 300 and may be implemented by a loop type metal bezel. For example, the conductive member 310 may define a thickness of the electronic device 300, or may contribute to at least a portion of the thickness of the electronic device 300. According to another embodiment, the conductive member 310 may be disposed at at least a portion of a periphery of the electronic device 300, or may expanded from a periphery of the electronic device 300 to a rear surface of the electronic device 300.

According to an embodiment, the conductive member 310 may be partitioned by one or more partition parts 315 and 316 of an insulation material. For example, when the electronic device 300 is viewed from the front side, the conductive member 310 may include a left side conductive member 311, a right side conductive member 312, an upper side metal member 313, and a bottom side conductive member 314.

According to an embodiment, the conductive members 311 to 314 partitioned by the partition parts 315 and 316 may be utilized as antenna radiators that are operated one or more frequency bands. For example, the conductive members 311 to 314 may be electrically connected to an internal conductive pattern, and may contribute as antenna radiators operated at one or more frequency bands according to the electrical lengths of the conductive members.

According to various embodiments, the antenna according to an embodiment of this disclosure may be mounted in a bottom area (area A) and an upper area (area B) of the electronic device 300. When the user grips the electronic device 300, area A or area B may correspond to an area in which the performance of the antenna is least lowered. However, the mounting location of the antenna is not limited to area A or area B. For example, the antenna may be disposed on at least one of opposite side surfaces of the electronic device, except for area A or area B.

Figure 3B:
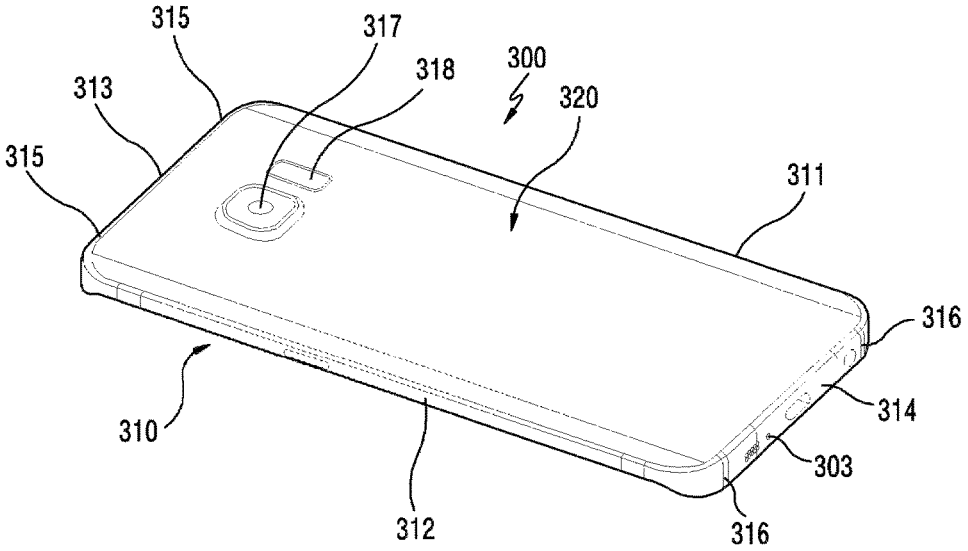
FIG. 3B is a diagram illustrating a rear perspective view of an electronic device according to various example embodiments of the present disclosure.

FIG. 3B is diagram illustrating a rear perspective view of an electronic device according to various example embodiments of the present disclosure.

Referring to FIG. 3B, a rear perspective view of the electronic device 300 is illustrated. In FIG. 3B, a description of the same configuration as that of FIG. 3A may be omitted. According to an embodiment, a rear camera 317, a flash 318, and/or a cover member 320 may be disposed on the rear surface of the electronic device 300. The cover member 320 may be detachably mounted on the electronic device 300, or may be integrally formed with the electronic device 300 to be implemented as a part of the housing.

According to an embodiment of this disclosure, the cover member 320 may be formed of various materials such as metal, glass, a composite material, and a synthetic resin. For example, when at least a portion of the cover member 320 is formed of a conductive material (e.g., metal), the conductive portion may be utilized as an antenna radiator.

Figure 3C:
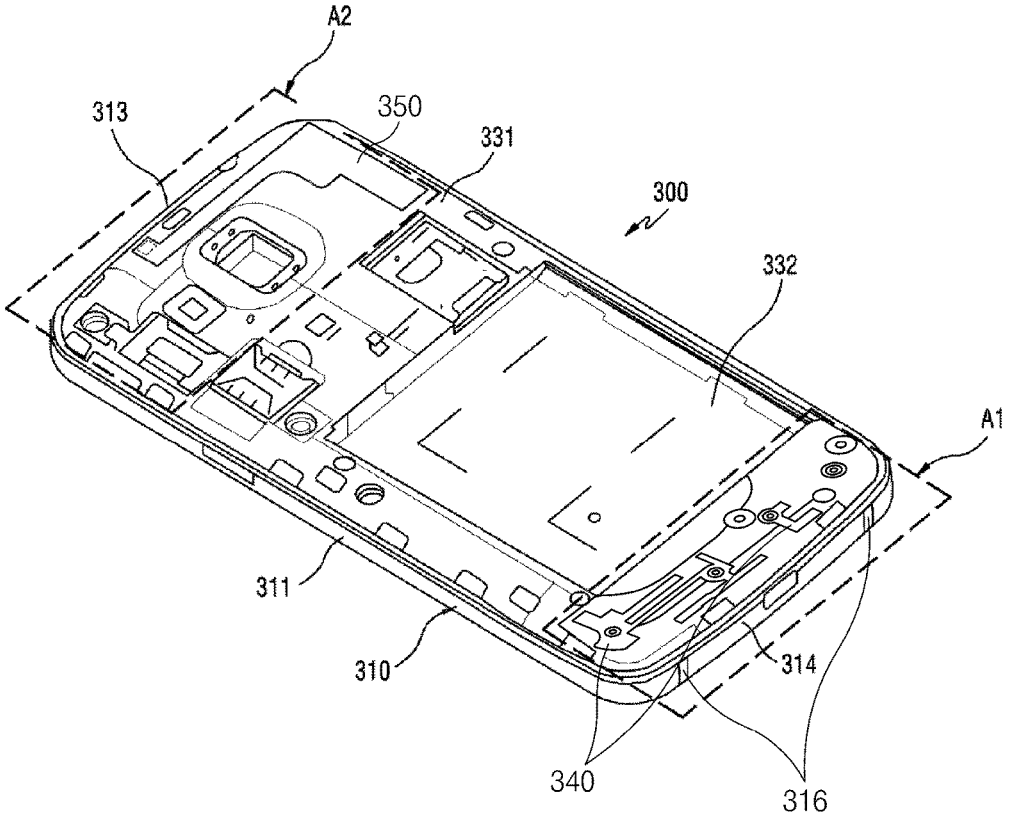
FIG. 3C is diagram illustrating a rear perspective view of an electronic device on which an antenna structure is mounted according to various example embodiments of the present disclosure.

FIG. 3C is diagram illustrating a perspective view of the interior of an electronic device according to various example embodiments of the present disclosure.

Referring to FIG. 3C, an internal configuration of the electronic device 300, from which the cover member 320 is removed, is illustrated. In FIG. 3C, a description of the same configuration as that of FIGS. 3A and 3B may be omitted.

Various modules and structures may be mounted on the rear surface 331 of the electronic device 300, from which the cover member 320 is removed. For example, a battery mounting part 332 for accommodating a battery may be formed on the rear surface 331 of the electronic device 300.

According to an embodiment, an antenna according to various embodiments of the present disclosure may be disposed in at least one of area A1 and area A2 of the rear surface 331 of the electronic device 300. According to an embodiment, area A1 may correspond to a bottom area of the electronic device 300 and area A2 may correspond to an upper area of the electronic device 300.

For example, conductive patterns (may referred to as antenna patterns or antenna radiators) 340 and 350 may be disposed in area A1 and area A2. The conductive patterns 340 and 350 may be electrically connected to a circuit board (not illustrated) such that electric power is fed to the conductive patterns 340 and 350 from a communication circuit disposed in the circuit board. According to an embodiment, portions of the conductive patterns 340 and 350 may extend to one point of the circuit board. According to another example, the conductive patterns 340 and 350 may be electrically connected to the circuit board through an electrical connection member (e.g., a C-clip or a flange).

According to various embodiments, at least a portion of the conductive member 310 included in the housing of the electronic device 300 may contribute as an antenna radiator. For example, the conductive pattern 340 disposed in area A1 may be connected to at least one of the left side conductive member 311, the right side conductive member 312, or the bottom side conductive member 314 directly (e.g., a connection using a flange) or indirectly (e.g., electromagnetic coupling). In this way, when the conductive pattern 340 is connected to at least one conductive member 311, 312, and 314 directly or indirectly, the at least one conductive member 311, 312, and 314 may be utilized as an antenna radiator.

Figure 4A:
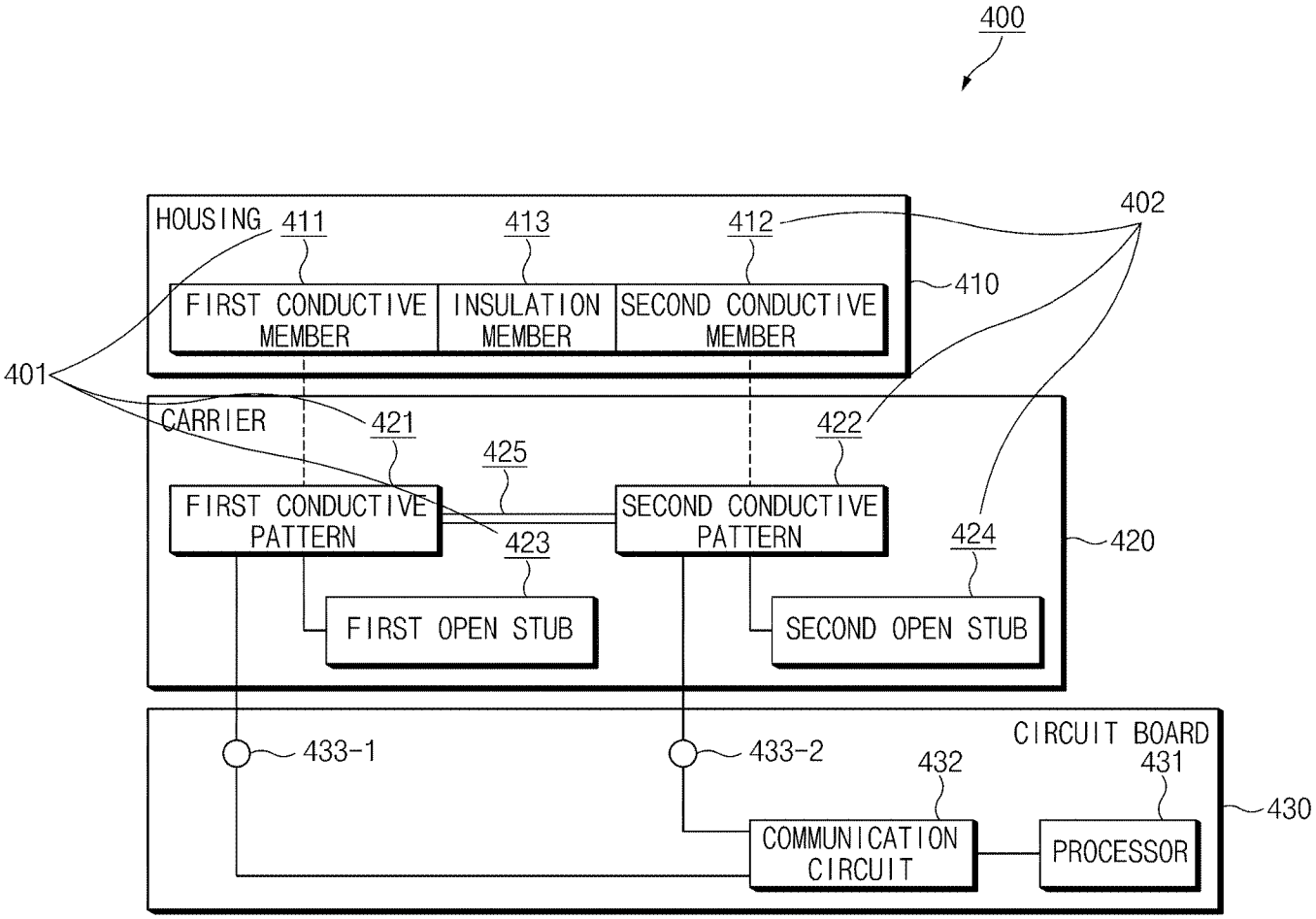
FIG. 4A is a block diagram illustrating an example electronic device according to an example embodiment of the present disclosure.

FIG. 4A is a block diagram illustrating an example electronic device according to an example embodiment of the present disclosure.

Referring to FIG. 4A, the electronic device 400 may include a housing 410, a carrier 420, and a circuit board 430. The electronic device 400 may correspond to the electronic device 101 of FIG. 1, the electronic device 201 of FIG. 2, or the electronic device 300 of FIGS. 3A to 3C, and at least one of the components of the electronic devices 101, 201, and 300 may be additionally included.

The housing 410 may define an external appearance of the electronic device 400, and may be formed of a plastic injection-molded material, a conductive member (e.g., metal) or a combination thereof to protect various components of the electronic device 400 from an external impact or dust. According to an embodiment, the housing 410 may include a first conductive member 411 (e.g., corresponding to the bottom side conductive member 314 of FIG. 3C), a second conductive member 412 (e.g., corresponding to the left side conductive member 311 of FIG. 3C), and an insulation member 413 (e.g., corresponding to a the partition part 316 of FIG. 3C). For example, in the housing 410, the first conductive member 411, the second conductive member 412, and the insulation member 413 may constitute at least a portion of a periphery (or a bezel) of the electronic device 400.

According to an embodiment, the first conductive member 411 may be electrically connected to the first conductive pattern 421 formed on a surface of the carrier 420, and the second conductive member 412 may be electrically connected to the second conductive pattern 422. The first conductive member 411 and the second conductive member 412 may be electrically connected to the first conductive pattern 421 and the second conductive pattern 422, respectively, to be utilized as portions of an antenna radiator for transmitting or receiving a wireless signal.

For example, the first conductive member 411 (or the second conductive member 412) may be connected to the first conductive pattern 421 (or the second conductive pattern 422) directly (e.g., a connection through a flange) or indirectly (e.g., electrical coupling). For example, the first conductive member 411 (or the second conductive member 412) is indirectly connected to the first conductive pattern 421 (or the second conductive pattern 422), the first conductive member 411 (or the second conductive member 412) may be spaced apart from the first conductive pattern 421 (or the second conductive pattern 422) to be electromagnetically coupled to the first conductive pattern 421 (or the second conductive pattern 422).

The insulation member 413 may electrically isolate the first conductive member 411 and the second conductive member 412. That is, the first conductive member 411 and the second conductive member 412 may be spaced apart from each other while the insulation member 413 is interposed between the first conductive member 411 and the second conductive member 412. For example, the insulation member 413 may be formed of a member (e.g., a plastic injection-molded material or rubber) having a low conductivity.

The carrier 420 may be disposed in the interior of the electronic device 400, and may be formed of an injection-molded insulation body. For example, a conductive pattern may be formed on a surface of the carrier 420. According to an embodiment, a first conductive pattern 421 and a first open stub 423 may be formed at at least a portion of a surface of the carrier 420, and a second conductive pattern 422 and a second open stub 424 may be formed at another portion of the surface of the carrier 420. According to an embodiment, the first conductive pattern 421 and the second conductive pattern 422 may be electrically connected to each other through a connection pattern 425.

The stub may refer, for example, to a portion of a conductive pattern branched and extending from any one point of an existing conductive pattern. That is, the stub may refer, for example, to a portion of the transmission line used for impedance matching of the transmission line. Further, the term "open" of the stub may refer, for example, to a situation in which the stub does not constitute a closed circuit with another electrical element. For example, if the stub extending from one point of the conductive pattern is not connected to a ground, it may be referred to as an open stub.

The first conductive pattern 421 may comprise a first antenna radiator 401 together with the first conductive member 411 and the first open stub 423. Electric power may be fed from the communication circuit 432 to the first antenna radiator 401 through a first port 433-1. The electronic device 400 may transmit or receive a signal of a specific frequency band by using a first antenna radiator.

The first conductive pattern 421 and the first conductive member 411 may have electrical lengths for transmitting or receiving a signal of a specific frequency band. Then, the first conductive member 411 may have a fixed length based on an external design of the electronic device 400. Accordingly, the first conductive pattern 421 may have an electrical length for shifting a central frequency to the specific frequency band (operation frequency band).

The first open stub 423 may extend from one point of the first conductive pattern 421. The first open stub 423 may be designed such that a signal of the specific frequency band substantially may not be transmitted and received to and from the first open stub 423.

Meanwhile, the second conductive pattern 422 may comprise a second antenna radiator 402 together with the second conductive member 412 and the second open stub 424. Electric power may be fed from the communication circuit 432 to the second antenna radiator 402 through a second port 433-2 independently from the first antenna radiator 401. The electronic device 400 may transmit or receive a signal of a specific frequency band by using a second antenna radiator. For example, the frequency band of the signal transmitted or received through the second antenna radiator 402 may overlap or coincide with the frequency band of the signal transmitted or received through the first antenna radiator 401.

The second conductive pattern 422 and the second conductive member 412 may have electrical lengths for transmitting or receiving a signal of a specific frequency band. Then, the second conductive member 412 may have a fixed length like the first conductive member 411. Accordingly, the second conductive pattern 422 may have an electrical length for shifting a central frequency to an operation frequency band.

The second open stub 424 may extend from one point of the second conductive pattern 421. The second open stub 424 may be designed such that a signal of the operation frequency band substantially may not be transmitted and received to and from the second open stub 424.

According to an embodiment, at least one of the first open stub 423 and the second open stub 424 may be designed such that a transmission coefficient between the first antenna radiator 401 and the second antenna radiator 402 is lower than a specific value at a specific frequency band. The transmission coefficient between the first antenna radiator 401 and the second antenna radiator 402 may be understood as an S parameter (S21 or S12) between the first port 433-1 and the second port 433-2.

In order to set the transmission coefficient such that the transmission coefficient is lower than a specific value, an electrical length of the first open stub 423 may designed to be shorter than a half of the electrical length of the first conductive pattern 421. Further, the electrical length of the second open stub 424 may be designed to be shorter than a half of the electrical length of the second conductive pattern 422 (see FIG. 4B).

Then, a capacitance component may be dominant in at least one of a reactance component of the first open stub 423 and a reactance component of the second open stub 424.

The specific value may be associated with isolation between the first antenna radiator 401 and the second antenna radiator 402. For example, the specific value may be a value of −15 dB. However, −15 dB is an example, and may be variously set, for example, to −17 dB or −20 dB according to an antenna designer.

According to an embodiment, the first conductive pattern 421 and the second conductive pattern 422 may be electrically connected to each other while a connection pattern 425 is interposed between the first conductive pattern 421 and the second conductive pattern 422. However, the present disclosure is not limited thereto, but when the connection pattern 425 is omitted, the first conductive pattern 421 and the second conductive pattern 422 may not be electrically connected to each other.

Further, according to various embodiments, the first conductive pattern 421, the second conductive pattern 422, the first open stub 423, and the second open stub 424 may be formed of a flexible printed circuit (FPC), may be formed through laser direct structuring (LDS), or may be formed of a direct printed antenna (DPA).

The LDS process may be a process of attaching an LDS resin (e.g., a thermoplastic resin) to the carrier 420 through insert injection-molding or the like, selectively patterning the LDS resin by applying a laser beam to the LDS resin, and plating copper (Cu) and nickel (Ni) by using an anchoring phenomenon.

The DPA process may be a process of filling silver (Ag) paste in a corrosion plate having a shape of an antenna radiator after the carrier 420 is injection-molded, and printing a pattern in the carrier 420 through pad printing.

Various types of antennas, such as an antenna, an in-mold antenna (IMA) or an FPC antenna using a stainless steel fusion process of punching a conductive pattern with a metal piece and thermally fusing the conductive pattern in the carrier 420, in addition to the LDS process and the DPA process, may be applied. According to another example, the first conductive pattern 421, the second conductive pattern 422, the first open stub 423, and the second open stub 424 may be formed through insert injection-molding or dual injection-molding in a manner in which they are exposed or not exposed to the electronic device 400.

The circuit board 430, for example, may be implemented by a printed circuit board (PCB) or a flexible printed circuit board (FPCB). According to an embodiment, the circuit board 430 may be referred to also as a main board. Various circuit configurations and/or modules (e.g., the communication circuit 432 and the processor 431) of the electronic device 400 may be mounted on the circuit board 430.

The processor 431 may include various processing circuitry and be electrically connected to the communication circuit 432 to control the communication circuit 432. For example, the processor 431 may include various processing circuitry, such as, for example, and without limitation, a dedicated processor, a CPU, a communication processor (CP) or an application processor (AP). According to some embodiments, the processor 431 may be provided as a configuration (e.g., a controller of the communication circuit 432) of the communication circuit 432.

According to an embodiment, the processor 431 may cause the communication circuit 432 to transmit or receive a signal of the same (or similar) frequency band (e.g., a Wi-Fi 2.4 GHz channel band or a 5 GHz channel band) through the first antenna radiator 401 and the second antenna radiator 402 in a multiple-input multiple-output (MIMO) manner.

The communication circuit 432 may include one or more types of communication circuits. For example, the communication circuit 432 may include a plurality of Wi-Fi communication circuits using the same frequency. As another example, the communication circuit 432 may include at least one of a Wi-Fi communication circuit, a ZigBee communication circuit, a cellular communication circuit, or a Bluetooth communication circuit. Further, although not illustrated in detail, the communication circuit 432 may include various filters or amplifiers for processing signals.

According to an embodiment, the communication circuit 432 may be electrically connected to (the first conductive pattern 421 of) the first antenna radiator 401 and (the second conductive pattern 422 of) the second antenna radiator 402 through the first port 433-1 and the second port 433-2. For example, the communication circuit 432 may include a first Wi-Fi communication circuit and a second Wi-Fi communication circuit, of which operation frequency bands at least partially overlap each other. In this case, the first Wi-Fi communication circuit may feed electric power to the first conductive pattern 421 through the first port 433-1, and the second Wi-Fi communication circuit may feed electric power to the second conductive pattern 422 through the second port 433-2.

The first port 433-1 and the second port 433-2 may function as interfaces between the first antenna radiator 401 and the second antenna radiator 402, and the communication circuit 450. For example, sides of the first port 433-1 and the second port 433-2 may be electrically connected to the first conductive pattern 421 and the second conductive pattern 422, respectively, and opposite sides of the first port 433-1 and the second port 433-2 may be electrically connected to the communication circuit 432. For example, the first port 433-1 and the second port 433-2 may include a conductive connection member (e.g., a C-clip or a wire spring), and may be electrically connected to the communication circuit 432 through a printed wiring line, a coaxial cable, or a microstrip line included in the circuit board 430. According to various embodiments, the first port 433-1 and the second circuit 433-2 may be included as a configuration of the communication circuit 432.

Figure 4B:
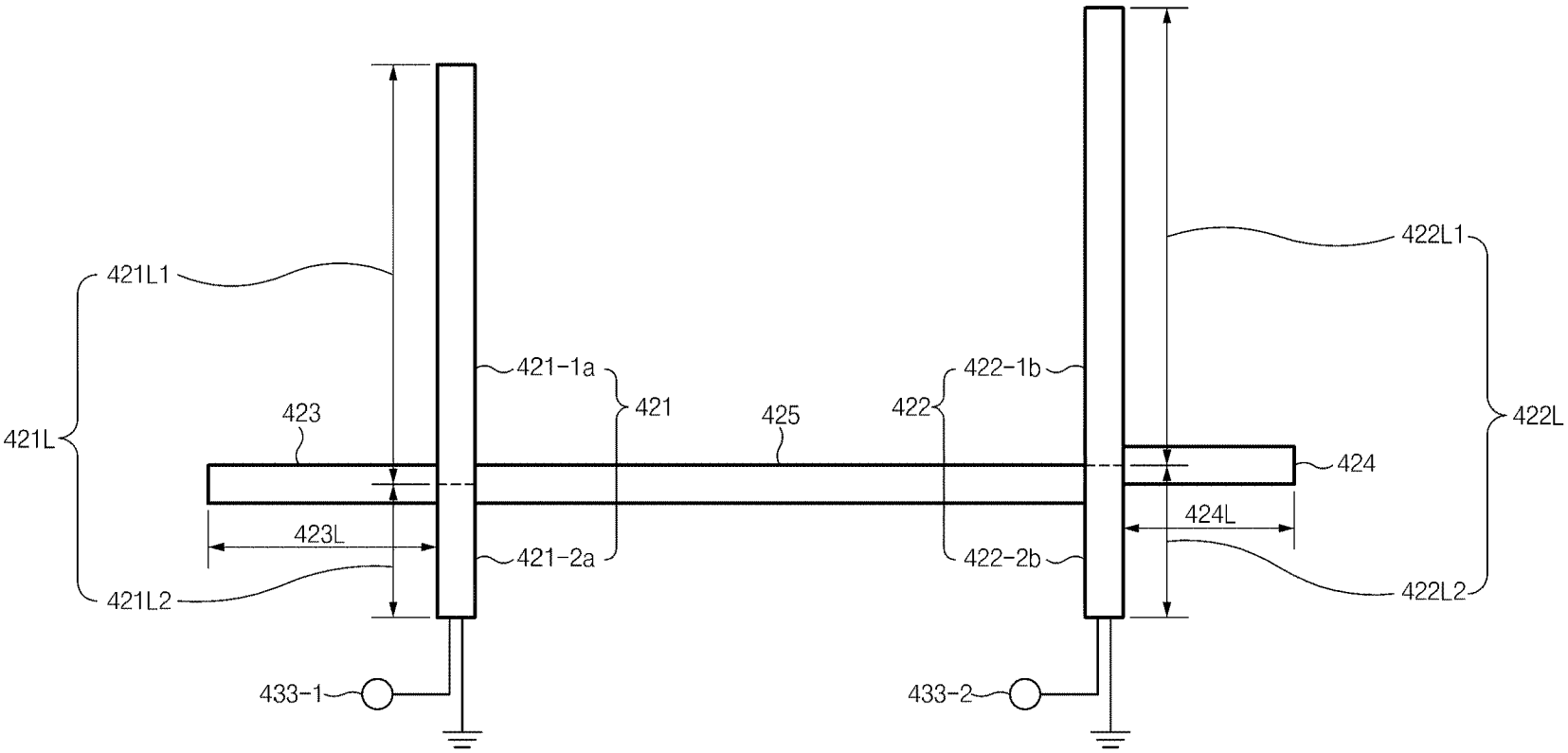
FIG. 4B is a diagram illustrating an example of a conductive pattern and an open stub according to an example embodiment of the present disclosure.

FIG. 4B is a diagram illustrating a design example of a conductive pattern and an open stub according to an example embodiment of the present disclosure.

Referring to FIG. 4B, the first conductive pattern 421, to which electric power is fed through the first port 433-1, the second conductive pattern 422 connected to the first conductive pattern 421 through the connection pattern 425 and to which electric power is fed through the second port 433-2, the first open stub 423 extending from one point of the first conductive pattern 421, and the second open stub 424 extending from one point of the second conductive pattern 422 are illustrated. In relation to FIG. 4A, some descriptions of the same reference numerals may be omitted. The first conductive pattern 421 may have an electrical length of 421L. According to an embodiment, the first conductive pattern 421 may be partitioned into a plurality of parts. For example, the first conductive pattern 421 may be partitioned into part 1*a* 421-1*a* and part 2*a* 421-2*a*. Accordingly, the electrical length 421L of the first conductive pattern 421 may be divided into a length 421L1 of part 1*a* 421-1*a* and a length 421L2 of part 2*a* 421-2*a* (i.e., 421L=421L1+421L2). Then, the first open stub 423 may extend from a boundary point of part 1*a* 421-1*a* and part 2*a* 421-2*a* by 423L.

For example, the electrical length 421L of the first conductive pattern 421 may be 14.5 mm, the length 421L1 of part 1*a* may be 11 mm, and the length 421L2 of part 2*a* may be 3.5 mm. Accordingly, the first open stub 423 may be designed to extend from a point that is 0.24 times as distant from the electrical length 421L of the first conductive pattern 421 (i.e., 421L:421L2=14.5 mm:3.5 mm=1:0.24).

Further, for example, the electrical length 423L of the first open stub 423 may be 6 mm. Accordingly, the electrical length 423L of the first open stub 423 may be 0.41 times as large as the electrical length 421L of the first conductive pattern 421 (i.e., 421L:423L=14.5 mm:6 mm=1:0.41).

Meanwhile, the second conductive pattern 422 may have an electrical length of 422L. Like the first conductive pattern 421, the second conductive pattern 422 may be partitioned into a plurality of parts. For example, the second conductive pattern 422 may be partitioned into part 1*b* 422-1*b* and part 2*b* 422-2*b*. Accordingly, the electrical length 422L of the second conductive pattern 422 may be divided into a length 422L1 of part 1*b* 422-1*b* and a length 422L2 of part 2*b* 422-2*b* (i.e., 422L=422L1+422L2). Then, the second open stub 424 may extend from a boundary point of part 1*b* 422-1*b* and part 2*b* 422-2*b* by 424L.

For example, the electrical length 422L of the second conductive pattern 422 may be 16 mm, the length 422L1 of part 1*b* 422-1*b* may be 12 mm, and the length 422L2 of part 2*b* 422-2*b* may be 4 mm. Accordingly, the second open stub 424 may be designed to extend from a point that is 0.25 times as distant from the electrical length 422L of the second conductive pattern 422 (i.e., 422L:422L2=16 mm:4 mm=1:0.25).

Further, for example, the electrical length 424L of the second open stub 424 may be 5 mm. Accordingly, the electrical length 424L of the second open stub 424 may be 0.31 times as large as the electrical length 422L of the second conductive pattern 422 (i.e., 422L:424L=16 mm:5 mm=1:0.31).

According to various embodiments, the length 423L of the first open stub 423 and the length 424L of the second open stub 424 are not limited to the example of FIG. 4B. For example, the length 423L of the first open stub 423 and the length 424L of the second open stub 424 may be 0.01 to 0.1 times, 0.01 to 0.35 times, or 0.01 to 0.5 times as large as the length 421L of the first conductive pattern 421 and the length 422L of the second conductive pattern 422, respectively.

According to various embodiments, the points from which the first open stub 423 and the second open stub 424 extend are not limited to the example of FIG. 4B. For example, the first open stub 423 and the second open stub 424 may extend from points that is 0.06 to 0.24 times or 0.01 to 0.5 times as distant as the length 421L of the first conductive pattern 421 and the length 422L of the second conductive pattern 422, respectively.

Figure 5:
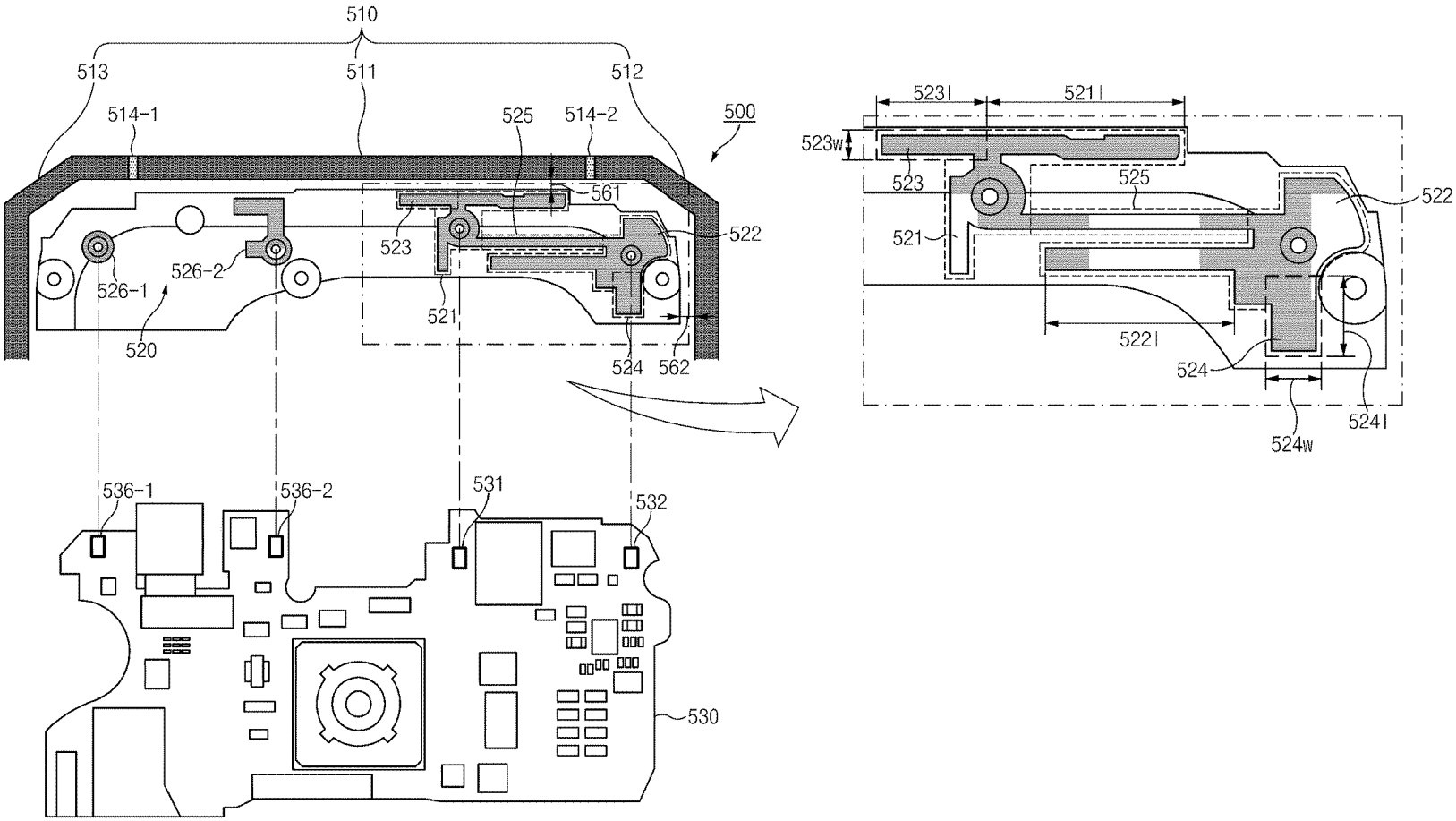
FIG. 5 is a diagram illustrating an example conductive pattern and an open stub of an antenna according to an example embodiment of the present disclosure.

FIG. 5 is a diagram illustrating an example conductive pattern and an open stub of an antenna according to an example embodiment of the present disclosure.

Referring to FIG. 5, an antenna structure of the electronic device 500 according to an embodiment is illustrated. For example, FIG. 5 may correspond to area A1 of FIG. 3B. The antenna according to an embodiment may include a housing 510 including a conductive member at at least a portion thereof, a carrier 520, conductive patterns 521, 522, 526-1, and 526-2 formed on a surface of the carrier 520, a connection pattern 525, and open stubs 523 and 524. Further, the antenna of the electronic device 500 of FIG. 5 is an example, and is not limited to the shape of FIG. 5. For example, the second open stub 524 and/or the connection pattern 525 may be omitted, and when the connection pattern 525 is omitted, the first conductive pattern 521 and the second conductive pattern 522 may be electrically isolated from each other.

The housing 510 may include a first conductive member 511, a second conductive member 512, a third conductive member 513, and insulation members (partition parts) 514-1 and 514-2. In the housing 510, the first conductive member 511, the second conductive member 512, and the third conductive member 513 may be spaced apart from each other while the insulation members 514-1 and 514-2 are interposed therebetween.

According to an embodiment, the first conductive member 511 may be electrically connected to the first conductive pattern 521, and the second conductive member 512 may be electrically connected to the second conductive pattern 422. For example, the first conductive member 511 may be spaced apart from the first conductive pattern 521 by a specific gap 561 to be electromagnetically coupled to the first conductive pattern 521. Further, the second conductive member 512 may be spaced apart from the second conductive pattern 522 by a specific gap 562 to be electromagnetically coupled to the second conductive pattern 522. Further, the third conductive member 513 may be electrically connected to the third conductive patterns 526-1 and 526-2, together with the first conductive member 511. The first conductive member 511 and the third conductive member 513 may be directly connected to the third conductive patterns 526-1 and 526-2 through a flange (not illustrated), or may be electromagnetically coupled to the third conductive patterns 526-1 and 526-2 to be indirectly connected to the third conductive patterns 526-1 and 526-2.

For example, based on the direct/indirect electrical connection, the first conductive member 511 and the first conductive pattern 521 may be operated as antenna radiators at a channel band of 2.4 GHz and/or 5 GHz, and the second conductive member 512 and the second conductive pattern 522 may be operated as antenna radiators at a channel band of 2.4 GHz. Further, for example, the first conductive member 511, the third conductive member 513, and the third conductive patterns 526-1 and 526-2 may be operated as antenna radiators at a channel band of 800 to 900 MHz and a channel band of 1.7 to 2.1 MHz.

The carrier 520 may be included within the housing 510. The first conductive pattern 521, the second conductive pattern 522, the third conductive patterns 526-1 and 526-2, the first open stub 523, and the second open stub 524 may be formed on a surface of the carrier 520.

According to an embodiment, the first open stub 523 may extend from one point of the first conductive pattern 521. For example, the first open stub 523 may have a rectangular shape having an electrical length of 523*l* and an electrical width of 523*w*. If the electrical length 523*l* of the first open stub 523 becomes larger, an inductance component of the first open stub 523 may increase, and if the electrical width 523*w* of the first open stub 523 becomes larger, an inductance component of the first open stub 523 may increase. Accordingly, the electrical length 523*l* of the first open stub 523 is set to be smaller than a half of the electrical length 521I of the first conductive pattern 521, the reactance component of the first open stub 523 may be capacitive. That is, the first conductive pattern 521 may perform a function that is similar to that of a shunt capacitor.

According to an embodiment, the second open stub 524 may extend from one point of the second conductive pattern 522, similarly to the first open stub 523. For example, the second open stub 524 may have a rectangular shape having an electrical length of 524*l* and an electrical width of 524*w*. If the electrical length 524*l* of the second open stub 524 becomes larger, an inductance component of the second open stub 524 may increase, and if the electrical width 524*w* of the second open stub 524 becomes larger, an inductance component of the second open stub 524 may increase. Accordingly, the electrical length 524*l* of the second open stub 524 is set to be smaller than a half of the electrical length 522l of the second conductive pattern 522, the reactance component of the second open stub 524 may be capacitive.

The circuit board 530 may be disposed under the carrier 520. The circuit board 530, for example, may be equipped with one or more (communication) ports 531, 532, 536-1, and 536-2 that may perform a function of a feeder. The one or more (communication) ports 531, 532, 536-1, and 536-2, for example, may be electrically connected to the conductive patterns 521, 522, 256-1, and 526-2, through a connection member (e.g., a C-clip). For example, the first port 531 may feed electric power to the first conductive pattern 521, and the second port 532 may feed electric power to the second conductive pattern 522. Further, the third ports 536-1 and 536-2 may feed electric power to the third conductive patterns 526-1 and 526-2.

Figure 6:
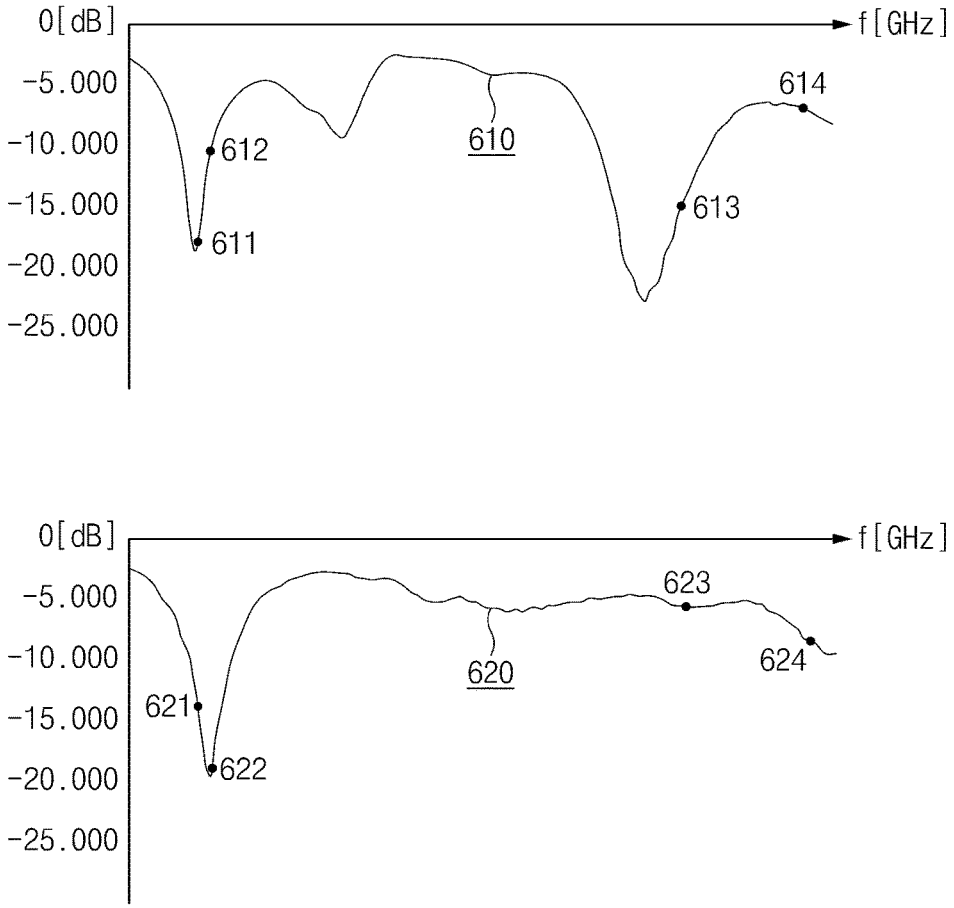
FIG. 6 is a graph depicting reflection coefficients S11 and S22 of a first antenna radiator and a second antenna radiator.

FIG. 6 are graphs depicting reflection coefficients S11 and S22 of a first antenna radiator and a second antenna radiator.

Referring to FIG. 6, curve 610 represents a reflection coefficient S11 (or a voltage standing wave ratio (VSWR)) of the first antenna radiator according to frequency (f), and curve 620 represents a reflection coefficient S22 of the second antenna radiator according to frequency (f). For example, curve 610 may correspond to a reflection coefficient of the first antenna radiator 401 at the first port 433-1 of FIG. 4A, and curve 620 may correspond to a reflection coefficient of the second antenna radiator 402 at the second port 433-2.

Referring to curve 610, a reflection coefficient S11 of the first antenna radiator at point 611 where frequency is 2.402 GHz is −17.496 dB, a reflection coefficient S11 of the first antenna radiator at point 612 where frequency is 2.480 GHz is −10.167 dB, a reflection coefficient S11 of the first antenna radiator at point 613 where frequency is 5.150 GHz is −14.888 dB, and a reflection coefficient S11 of the first antenna radiator at point 614 where frequency is 5.850 GHz is −6.961 dB.

Meanwhile, referring to curve 620, a reflection coefficient S22 of the second antenna radiator at point 621 where frequency is 2.402 GHz is −13.619 dB, a reflection coefficient S22 of the second antenna radiator at point 622 where frequency is 2.480 GHz is −18.925 dB, a reflection coefficient S22 of the second antenna radiator at point 623 where frequency is 5.150 GHz is −5.707 dB, and a reflection coefficient S22 of the second antenna radiator at point 624 where frequency is 5.850 GHz is −8.634 dB.

It can be seen that both the reflection coefficient S11 of the first antenna radiator and the reflection coefficient S22 of the second antenna radiator at 2.402 to 2.480 GHz that is a Wi-Fi channel band of 2.4 GHz show an excellent performance of −10 dB. That is, the first antenna radiator and the second antenna radiator may be operated at a frequency band of 2.402 to 2.480 GHz. The reflection coefficient S22 of the second antenna radiator at 5.150 to 5.850 GHz that is a Wi-Fi channel band of 5 GHz may be lower than the reflection coefficient S11 of the first antenna radiator. Accordingly, the first antenna radiator is set to be operated at channel bands of 2.4 GHz and 5 GHz, and the second antenna radiator may be set to be operated at a channel band of 2.4 GHz.

Figure 7:
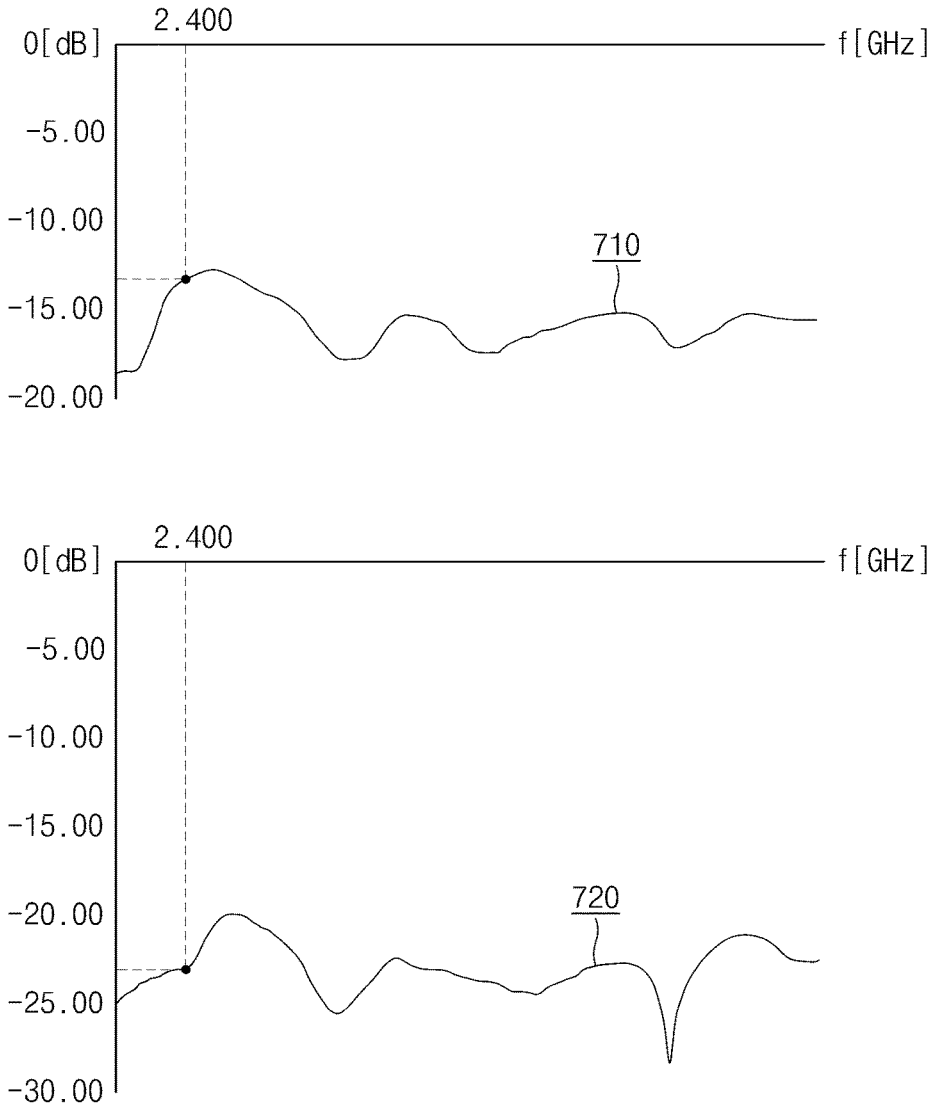
FIG. 7 is a graph depicting a reflection coefficient S21 between a first antenna radiator and a second antenna radiator.

FIG. 7 are graphs depicting a reflection coefficient S21 between a first antenna radiator and a second antenna radiator.

Referring to FIG. 7, curve 710 represents a transmission coefficient S21 between the first antenna radiator and the second antenna radiator according to frequency (f) when the open stub (e.g., 423 and 424 of FIG. 4A or 523 and 524 of FIG. 5) according to an embodiment of this disclosure is not formed in the carrier. Curve 720 represents a transmission coefficient S21 between the first antenna radiator and the second antenna radiator according to frequency (f) when the open stub according to an embodiment of this disclosure is formed in the carrier.

According to curve 710, when the open stub according to an embodiment of this disclosure is not formed in the carrier, a transmission coefficient S21 at 2.400 GHz is −12.82 dB. Meanwhile, according to curve 720, when the open stub according to an embodiment of this disclosure is formed in the carrier, a transmission coefficient S21 at 2.400 GHz is −23.86 dB.

The transmission coefficient S21 may correspond to a ratio of a signal introduced from the first antenna radiator to the second antenna radiator. Accordingly, as the transmission coefficient S21 decreases, an isolation between the first antenna radiator and the second antenna radiator may be improved (that is, an interference between the antenna radiators may be reduced). According to curve 710 and curve 720, it may be identified that the transmission coefficient is improved by 11.04 dB (about 12.7 times) due to the open stub according to an embodiment of this disclosure.

Figure 8A:
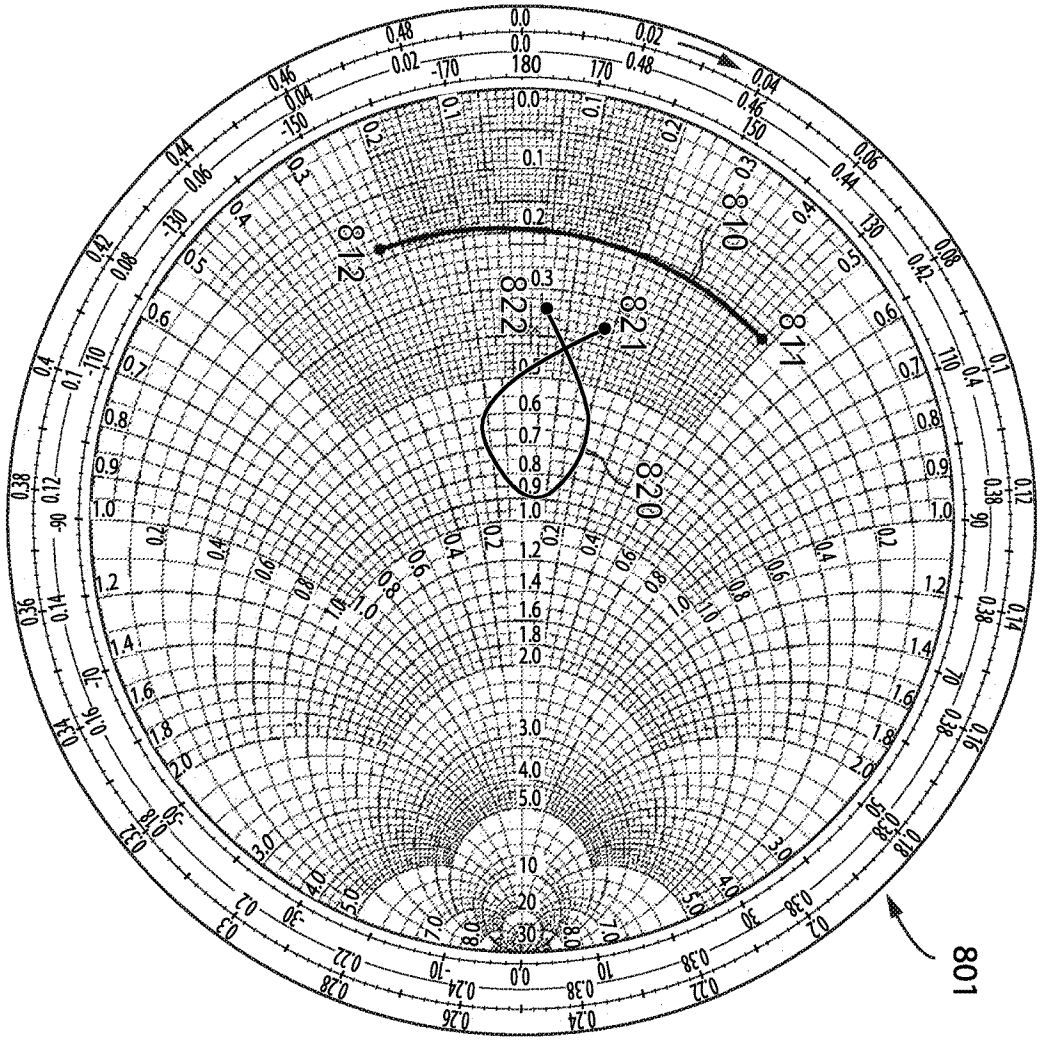
FIGS. 8A and 8B are diagrams illustrating shift of an impedance matching point on a Smith chart.
Figure 8B:
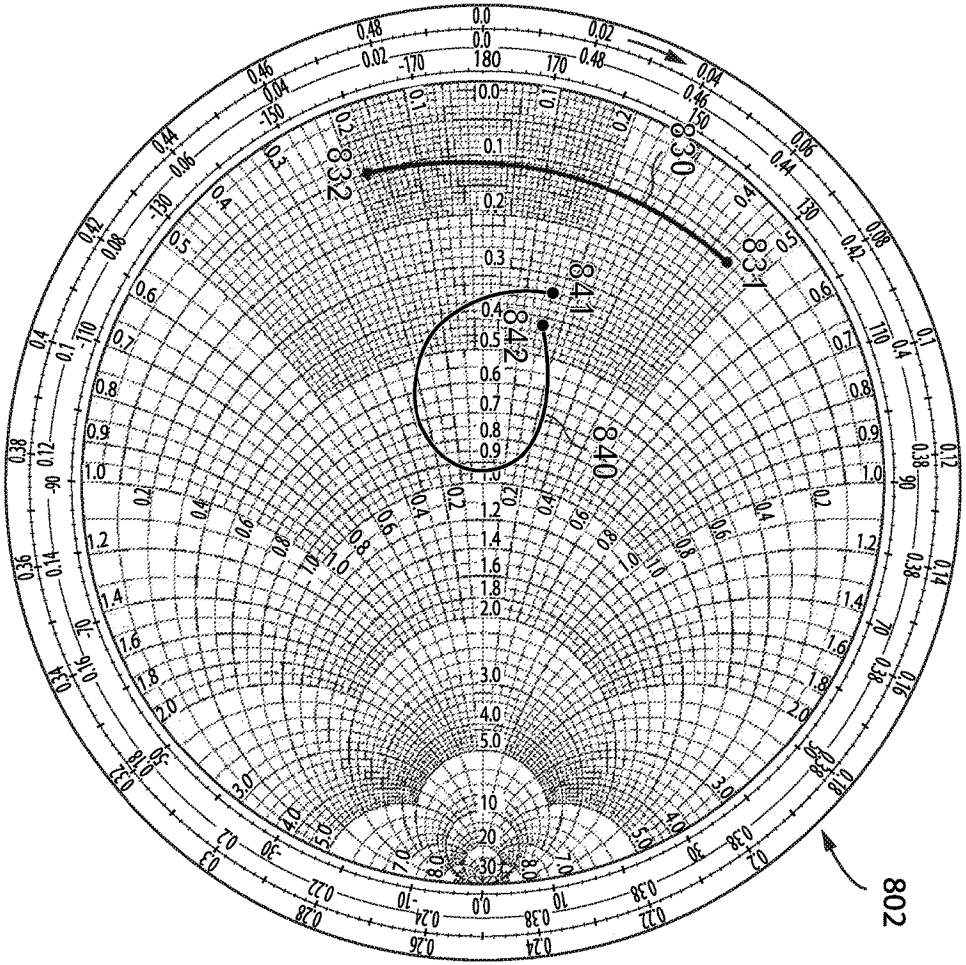

FIGS. 8A and 8B are diagrams illustrating shift of an impedance matching point on a Smith chart.

Referring to Smith chart 801 of FIG. 8A, a locus 810 of an impedance matching point of the second antenna radiator and a locus 820 of an impedance matching point of the first antenna radiator when the open stubs (e.g., 423 and 424 of FIG. 4A and 523 and 524 of FIG. 5) according to an embodiment of this disclosure is not formed in the carrier are illustrated.

According to the locus 810 at the impedance matching point of the second antenna radiator, the matching point 811 may correspond to a matching point when operation frequency is 2.402 GHz, and the matching point 812 may correspond to a matching point when operation frequency is 2.480 GHz. As operation frequency increases from 2.402 GHz to 2.480 GHz, the matching point may be shifted along the locus 810. Meanwhile, according to the locus 820 at the impedance matching point of the first antenna radiator, the matching point 821 may correspond to a matching point when operation frequency is 2.402 GHz, and the matching point 822 may correspond to a matching point when operation frequency is 2.480 GHz. As operation frequency increases from 2.402 GHz to 2.480 GHz, the matching point may be shifted along the locus 820.

Referring to Smith chart 802 of FIG. 8B, a locus 830 of an impedance matching point of the second antenna radiator and a locus 840 of an impedance matching point of the first antenna radiator when the open stubs (e.g., 423 and 424 of FIG. 4A and 523 and 524 of FIG. 5) according to an embodiment of this disclosure is formed in the carrier are illustrated.

According to the locus 830 at the impedance matching point of the second antenna radiator, the matching point 831 may correspond to a matching point when operation frequency is 2.402 GHz, and the matching point 832 may correspond to a matching point when operation frequency is 2.480 GHz. As operation frequency increases from 2.402 GHz to 2.480 GHz, the matching point may be shifted along the locus 830. Meanwhile, according to the locus 840 at the impedance matching point of the first antenna radiator, the matching point 841 may correspond to a matching point when operation frequency is 2.402 GHz, and the matching point 842 may correspond to a matching point when operation frequency is 2.480 GHz. As operation frequency increases from 2.402 GHz to 2.480 GHz, the matching point may be shifted along the locus 840.

In comparison of Smith chart 801 and Smith chart 802, as the open stubs (e.g., 423 and 424 of FIG. 4A or 523 and 524 of FIG. 5) according to an embodiment of this disclosure is additionally formed in the carrier, it can be seen that the location and shape of the locus of the matching points are changed in the Smith chart. For example, it can be seen that the distance between the locus 830 and the locus 840 associated with the isolation is larger than the distance between the locus 810 and the locus 820. That is, as the open stub according to an embodiment of this disclosure is additionally formed, it can be seen that an isolation between the first antenna radiator and the second antenna radiator is improved.

According to various example embodiments of the present disclosure, as at least one open stub extending from the conductive pattern is formed in the carrier, an isolation between a plurality of antennas operated at the same (or similar) frequency band may be improved. Accordingly, a mutual interference between the antennas may be reduced while the radiation performance of the MIMO antenna operated at the same (or similar) frequency band is maintained. Further, as the electrical length and/or the electrical width of the open stub according to an embodiment of this disclosure is adjusted, fine impedance matching (or tuning) may be performed.

An electronic device according to an embodiment may include a carrier, a first antenna radiator configured to transmit and/or receive a signal of a specific frequency band, a second antenna radiator configured to transmit and/or receive a signal of the specific frequency band, a communication circuit electrically connected to the first antenna radiator and the second antenna radiator, and a processor configured to control the communication circuit, the first antenna radiator may include a first conductive pattern formed at a portion of a surface of the carrier, the second antenna radiator may include a second conductive pattern formed at another portion of the surface of the carrier, and the first antenna radiator may include a first open stub extending from one point of the first conductive pattern such that a transmission coefficient between the first antenna radiator and the second antenna radiator is lower than a specific value at the specific frequency band.

According to another example embodiment, the second antenna radiator may further include a second open stub extending from one point of the second conductive pattern such that the transmission coefficient between the first antenna radiator and the second antenna radiator is lower than the specific value at the specific frequency band.

According to another example embodiment, an electrical length of the first open stub may be less than a half of an electrical length of the first conductive pattern.

According to another example embodiment, a capacitance component may be dominant in a reactance component of the first open stub.

According to another example embodiment, an electrical length of the second open stub may be less than a half of an electrical length of the second conductive pattern.

According to another example embodiment, a capacitance component may be dominant in a reactance component of the second open stub.

According to another example embodiment, the first conductive pattern and the second conductive pattern may be electrically connected to each other.

According to another example embodiment, the electronic device may further include a housing defining an external appearance of the electronic device and including a first conductive member and a second conductive member, and the first conductive member is electrically connected to the first conductive pattern and the second conductive member is electrically connected to the second conductive pattern.

According to another example embodiment, the first conductive member may be spaced apart from the first conductive pattern by a specific gap to be electromagnetically coupled to the first conductive pattern.

According to another example embodiment, the first conductive member and the second conductive member may be spaced apart from each other while an insulation member is interposed between the first conductive member and the second conductive member.

According to another example embodiment, the processor may be configured to cause the communication circuit to transmit and/or receive a signal of a specific band through the first antenna radiator and the second antenna radiator, in an multiple-input multiple-output (MIMO) manner.

An antenna mounted on an electronic device according to an example embodiment may include a carrier, a first antenna radiator configured to transmit and/or receive a signal of a specific frequency band, and a second antenna radiator configured to transmit and/or receive a signal of the specific frequency band, the first antenna radiator including a first conductive pattern formed at a portion of a surface of the carrier, the second antenna radiator including a second conductive pattern formed at another portion of the surface of the carrier, and the first antenna radiator includes a first open stub extending from one point of the first conductive pattern such that a transmission coefficient between the first antenna radiator and the second antenna radiator is lower than a specific value at a specific frequency band.

According to another example embodiment, the second antenna radiator may further include a second open stub extending from one point of the second conductive pattern such that the transmission coefficient between the first antenna radiator and the second antenna radiator is lower than the specific value at the specific frequency band.

According to another example embodiment, an electrical length of the first open stub may be less than a half of an electrical length of the first conductive pattern.

According to another example embodiment, a capacitance component may be dominant in a reactance component of the first open stub.

According to another example embodiment, an electrical length of the second open stub may be less than a half of an electrical length of the second conductive pattern.

According to another example embodiment, a capacitance component may be dominant in a reactance component of the second open stub.

According to another example embodiment, the first conductive pattern and the second conductive pattern may be electrically connected to each other.

According to another example embodiment, the first antenna radiator and the second antenna radiator may transmit or receive signals in an multiple-input multiple-output (MIMO) manner.

According to another example embodiment, the first conductive pattern and the second conductive pattern may be formed of a flexible printed circuit (FPC) on the carrier, are formed through laser direct structuring (LDS) or are formed of a direct printed antenna (DPA).

The term "module" used in the disclosure may refer, for example, to a unit including, for example, one of hardware, software, or firmware or a combination of the two or more of them. The module may be interchangeably used, for example, with a unit, logic, a logical block, a component, or a circuit. The module may be a minimum unit or a part of an integrally configured part. The module may be a minimum unit or a part which performs one or more functions. The module may be implemented mechanically or electromagnetically. For example, the module may include at least one of a dedicated processor, a CPU, an application-specific integrated circuit (ASIC) chip, a field-programmable gate array, or a programmable-logic device, or the like, which has been known, will be developed in the future, or performs certain operations.

At least some of the devices (e.g., modules or functions) or methods (e.g., operations) according to various example embodiments of the present disclosure may be implemented by an instruction stored in a computer-readable storage medium, for example, in the form of a program module. When the instruction is executed by the processor (e.g., the processor 120), the at least one processor may perform a function corresponding to the instruction. The computer-readable storage medium may be, for example, a memory 130.

The computer-readable storage medium may include a hard disk, a floppy disk, a magnetic medium (e.g., a magnetic tape), an optical medium (e.g., a compact disk read only memory (CD-ROM)), a digital versatile disk (DVD), a magneto-optical medium (e.g., a floptical disk), a hardware device (e.g., a read only memory (ROM), a random access memory (RAM), or a flash memory). Further, the program instructions may include high-level language codes which may be executed by a computer using an interpreter as well as machine languages created by using a compiler. The above-mentioned hardware device may be configured to be operated as one or more software module to perform operations of various embodiments, and the converse is true.

The module or program module according to various embodiments of the present disclosure may include at least one of the above-mentioned element, omit some of them, or further include other elements. The module, the program module, or the operations performed by other elements according to various embodiments of the present disclosure may be performed in a sequential, parallel, iterative, or heuristic method. Further, some operations may be executed in another sequence or may be omitted, or other operations may be added.

According to various embodiments of the present disclosure, as at least one open stub extending from the conductive pattern is formed in the carrier, an isolation between a plurality of antennas operated at the same (or similar) frequency band may be improved. In addition, the present disclosure may provide various effects that are directly or indirectly recognized.

Further, the various example embodiments disclosed in the disclosure are provided to describe the technical contents or for understanding of the technical contents, and the technical scope of the present disclosure is not limited thereto. Accordingly, the scope of the present disclosure should be understood to include all changes or various embodiments based on the technical spirit of the present disclosure.

What is claimed is:

1. An electronic device comprising:

a housing providing an external appearance of the electronic device and comprising a first conductive member and a second conductive member;

a carrier, the carrier having a surface;

a first antenna radiator configured to transmit and/or receive a signal of a specific frequency band;

a second antenna radiator configured to transmit and/or receive a signal of the specific frequency band;

a communication circuit electrically connected to the first antenna radiator and the second antenna radiator; and a processor configured to control the communication circuit, wherein the first antenna radiator comprises a first conductive pattern disposed at a portion of the surface of the carrier, wherein the second antenna radiator comprises a second conductive pattern disposed at another portion of the surface of the carrier, and wherein the first antenna radiator comprises a first open stub extending from one point of the first conductive pattern and configured to provide a transmission coefficient between the first antenna radiator and the second antenna radiator that is lower than −20 dB at the specific frequency band;

wherein the specific frequency band includes 2.4 GHz for Wi-Fi;

wherein the first conductive member is electrically connected to the first conductive pattern, and the second conductive member is electrically connected to the second conductive pattern; and wherein the first conductive member and the second conductive member are spaced apart from each other and an insulation member is interposed between the first conductive member and the second conductive member.

2. The electronic device of claim 1, wherein the second antenna radiator further comprises:

a second open stub extending from one point of the second conductive pattern and configured to provide a transmission coefficient between the first antenna radiator and the second antenna radiator that is lower than −20 dB at the specific frequency band.

3. The electronic device of claim 1, wherein an electrical length of the first open stub is less than half of an electrical length of the first conductive pattern.

4. The electronic device of claim 1, wherein a capacitance component is dominant in a reactance component of the first open stub.

5. The electronic device of claim 2, wherein an electrical length of the second open stub is less than half of an electrical length of the second conductive pattern.

6. The electronic device of claim 2, wherein a capacitance component is dominant in a reactance component of the second open stub.

7. The electronic device of claim 1, wherein the first conductive pattern and the second conductive pattern are electrically connected to each other.

8. The electronic device of claim 1, wherein the first conductive member is spaced apart from the first conductive pattern by a specific gap to be electromagnetic ally coupled to the first conductive pattern.

9. The electronic device of claim 1, wherein the processor is configured to cause the communication circuit to transmit and/or receive a signal of a specific band through the first antenna radiator and the second antenna radiator, in a multiple-input multiple-output (MIMO) manner.

* * * * *